United States Patent [19]

Schmidt

[11] Patent Number: 4,580,920

[45] Date of Patent: Apr. 8, 1986

[54] STICK DISPENSER

[76] Inventor: Gerhard S. E. Schmidt, 208 Duplex Ave., Toronto, Ontario, Canada

[21] Appl. No.: 531,460

[22] Filed: Sep. 12, 1983

[51] Int. Cl.[4] ..... B43K 5/06; A45D 40/26

[52] U.S. Cl. ..... 401/175; 401/75; 132/88.7

[58] Field of Search ..... 401/55, 63, 64, 68, 401/72, 75, 171, 172, 174, 175, 176, 177, 79

[56] References Cited

U.S. PATENT DOCUMENTS

| | | | |
|---|---|---|---|
| 2,818,167 | 12/1957 | McKinley | 401/175 |
| 3,802,023 | 4/1974 | Spatz | 401/175 X |
| 3,907,441 | 9/1975 | Idec et al. | 401/175 |
| 4,201,490 | 5/1980 | D'Angelo | 401/175 |
| 4,369,158 | 1/1983 | Woodruff et al. | 401/175 |

FOREIGN PATENT DOCUMENTS

| | | | |
|---|---|---|---|
| 0803383 | 10/1958 | United Kingdom | 401/79 |
| 0890683 | 3/1962 | United Kingdom | 401/79 |

*Primary Examiner*—Gene Mancene
*Assistant Examiner*—Carolyn A. Harrison
*Attorney, Agent, or Firm*—George A. Rolston

[57] ABSTRACT

A dispensing container for a product having a tubular container body with a dispensing end, and an operating end, a plug in the container near the operating end, and movable towards the dispensing end, a disc forming part of the plug in sealing engagement with the inside of the container body, and a locating sleeve within the operating end of the container formed integrally therewith.

4 Claims, 4 Drawing Figures

STICK DISPENSER

The invention relates to containers for skin care products, and in particular to tubular containers for stick type skin products such as deodorants and the like.

BACKGROUND OF THE INVENTION

Stick type personal care products comprise a stick of a waxy gel-like compound, which may be used as a deodorant, lipstick, or any other form of skin care products. The standard type of container for such products comprises a cylindrical tube or sleeve, with a removal cap at one end, and a movable interior plug at the other end. As the stick becomes used, the plug can be moved up the cylindrical container, so as to extend the end of the stick out of the container.

Generally speaking two types of extension systems are available. In the one case, a threaded screw is provided within the stick of the product, and a rotary knob is provided at the lower end of the container. The knob is connected to the screw. As the knob is rotated, the screw also rotates, and this causes the stick of material to be gradually extended from the container. Usually, such a system will incorporate a plug, which is threaded on to the threaded rod, and as the rod is located the plug is forced up through the tubular container.

The other common type of extension system is a lower cost simpler system in which a moveable plug is provided in the bottom of the container, and the bottom of the container is left open. A finger, or a rod such as a pencil can be inserted in the open end of the tube, and the plug is pushed up, thereby extending the stick of product from the tube.

This is obviously a less expensive mechanism, and while it suffers from the minor disadvantage that if excessive pressure is placed on the end of the stick while the product is being applied to the skin, the stick may slide back into the tube, it nevertheless is found to function satisfactorily for most purposes.

The existence of these two different systems can however create problems for the manufacturer.

The cost of the containers and packaging for such skin care products constitutes a major portion of the total cost of the item, and manufacturers are always seeking ways to reduce the packaging cost as far as possible so long as it does not impair the function of the product. The labelling of such products is usually applied by silk screening or hot stamping on the outside of the container, and this too adds significantly to the cost of the package.

In addition, the storage of such containers until they are filled and shipped out from the plant represents a significant expense to the manufacturer.

Where for example two different forms of containers are required: one for the screw-threaded type of dispenser; and the other for the pressure plug type of dispenser; then this will significantly increase the manufacturing costs of the product.

It is therefore desirable if possible that the tubular containers shall be capable of being used with both forms of dispenser that is to say both with a screw-threaded type of dispenser and also with a pressure plug type of dispenser. This will substantially reduce the manufacturing costs, since it will be possible to manufacture the tubes, and label them, in greater numbers at any given time, thereby obtaining significant economies in mass manufacture, and in addition, it will be possible to reduce the numbers of containers required to be kept in storage thereby adding to the savings achieved.

Another significant factor in this type of container is the effectiveness of the seal between the plug at the bottom end of the container and the inner side walls of the container. The containers are usually filled with the product in a semi-liquid state, and the product then sets in the container. Consequently, it is essential to provide an effective seal at the lower end of the container, so that the product while it is being filled does not escape around the plug. This creates undesirable results for the purchaser who may then have to clean up the container before using the product.

It is therefore apparent that whichever type of ejection mechanism is used, whether it be screw-threaded, or pressure plug, the seal between the plug and the container must be effective so as to reduce or eliminate these problems.

BRIEF SUMMARY OF THE INVENTION

The invention seeks to overcome the foregoing problems and comprises a tubular container open at both ends and adapted to receive a product therein for dispensing progressively from one end, and including a plug member received within said container, and adapted to be located adjacent the lower end of said stick, and movable along said container for ejecting said stick progressively from said container at the other end of said container, said plug member having a disc portion directed forwardly, and making sealing engagement with the sides of said container, and a sleeve portion within said end of said container adjacent said plug member, said stop portion operably restraining movement of said plug member outwardly of said container.

More particularly, the invention seeks to provide a container having the foregoing features and advantages, including threaded means within said plug member, a screw-threaded rod extending through said threaded means, axially up the centre of said container and manually engageable means attached to said threaded rod, and being rotatable whereby to cause said plug member to move from one end towards the other of said container.

A further and related objective of the invention is the provision of such a container having a plug member, and such plug member further having a rearwardly directed generally frusto-conical wall portion extending into engagement with said sleeve, said plug portion being manually movable along said container towards the other end of said container for manually dispensing said stick.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
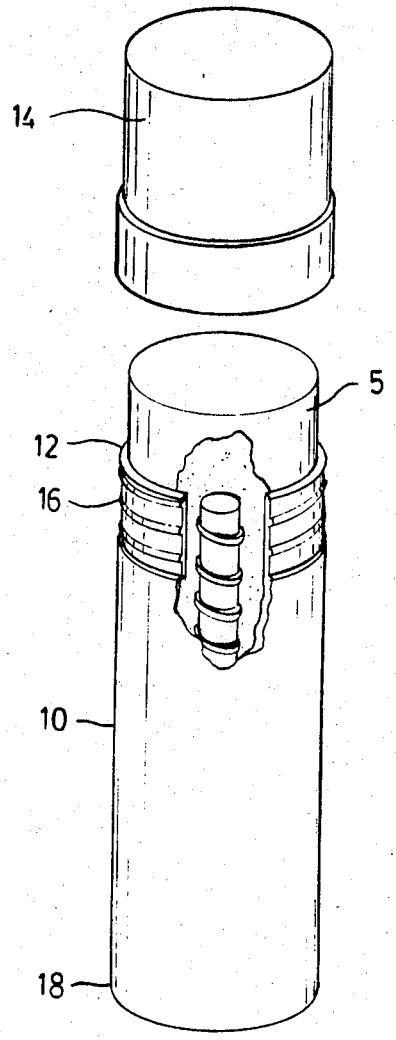
FIG. 1 is a perspective illustration partially cut away, showing a container according to the invention showing a stick of material therein.

As shown in FIG. 1, the invention is illustrated in connection with a typical skin care product such as a stick of deodorant, or other solid waxy skin care products such as lipstick, or any other products which may be dispensed from a stick in this way.

The invention is merely illustrated in connection with a skin care product, which is the most familiar example. Numerous other products can be packaged in the same way. For example, glue sticks are commonly packaged in such applicators.

For the purposes of this description therefore the contents of the container are regarded as essentially irrelevant, and will be referred to simply as the "Stick Product", and is identified as S.

Figure 2:
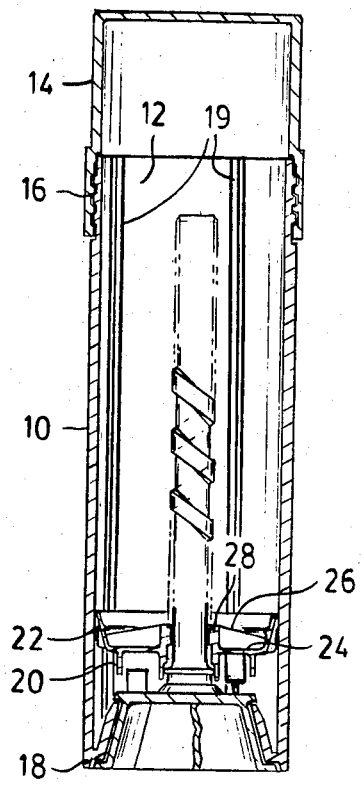
FIG. 2 is a section along the line 2—2 of FIG. 1, with a stick of material omitted.

As shown in FIGS. 1 and 2, the invention will be seen to comprise a container indicated generally as 10 of generally regular cylindrical shape. It has an upper end 12 provided with a closure cap 14, typically being attached thereto by some form of attachment such as the threads 16.

At the lower end 18 of the container 10, the container is open, and is provided with a movable plug or plunger indicated generally as 20.

In the embodiment of FIG. 2, the plug or plunger 20 has a forwardly directed sealing skirt 22 which is tapered to a feathered edge, so that it brushes along the inner surface of the container 10. The plug 20 further has a generally annular web portion 24, preferably provided with a plurality of reinforcing ribs 26 extending generally radially.

A central hub 28 is formed along the central axis of the plug 20, and has internal threads 30 formed therein.

The stick product S fills the interior of the container 10 and rests on the plug 20.

A threaded shaft 32 extends up the center of container 10 within the stick S. Shaft 32 fits within the internal threads 30, so that when the shaft 32 is rotated, the plug member 20 is forced to move along the interior of the container 10, and thus extend the stick S.

In order to manually engage and rotate the shaft 32, a drive disc 34 is attached to the lower end of the shaft. Disc 34 may be provided with finger flanges or abutments (not shown), by means of which it may be engaged and rotated. In order to retain the drive disc 34 within the lower end of the container 10, and still permit it to rotate, the lower end of the container 10 is provided with an inwardly directed sleeve 36, having a shoulder 38 at its lower end. Preferably, the sleeve extends inwardly in a general frusto-conical manner, as shown.

Drive disc 34 is provided with a generally frusto-conical downwardly dependent wall 40, arranged at an angle generally corresponding to that of the sleeve 36 having a rim 42 to provide a sliding rotary bearing action against shoulder 38.

An annular retaining lip 44 is formed on the drive disc 34, for interengaging with the sleeve 36. This provides a snap action form of engagement, and once the drive disc is inserted and snapped into position, it cannot then be withdrawn without special tools.

In this way, the drive disc is held in location in the lower end of the container 10, and is yet free to rotate. In this way by means of finger engagement, the user can rotate the drive disc and thus rotate the shaft.

In order to seal around shaft 32, a sealing collar 46 is formed on hub 28 extending downwardly, having a resilient thin wall portion 48. A sealing ring 50 is formed on shaft 32, having a generally curved profile, to contact thin wall portion 48 and form a seal.

In order to provide a stop for plug 20, and limit its lower movement a flange 52 extends downwardly from disc 24. A further flange 53 extends upwardly from disc 34. Flanges 52 and 53 engage one another and stop rotation of disc 34. This stops plug 20.

It will, of course, be appreciated that the stick product will be located within the container, with its lower end resting on the plug member. The shaft 32 will be embedded in the centre of the mass of stick S.

In order to dispense the product from the open upper end of the container, the drive disc is simply rotated, and this will force the plug up the container, thereby causing the stick product to move upwardly, so that the upper end is exposed at the upper open end of the container.

This form of the invention provides a good effective seal between the feathered edge of the plug 20 and the container, and prevents the escape of any of the stick product during filling, for example, or during storage, and insures that it is dispensed cleanly during use.

In addition, the provision of the snap fitting between the drive disc and the retaining flange of the container provides a simple assembly operation which can readily be carried out using a simple jig, or even by hand if necessary. No special fastening systems are required, and the fastening effectively secures the members together while permitting free rotation in the manner necessary for dispensing of the product.

Figure 4:
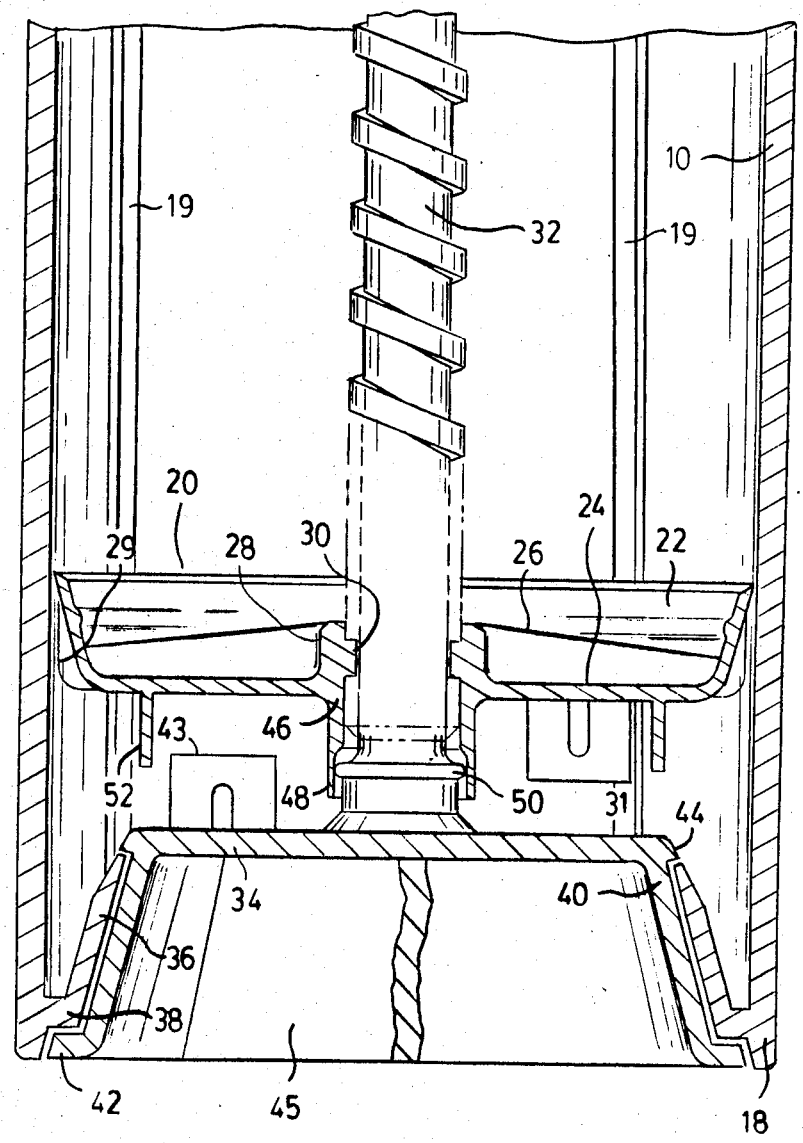

Manufacturers of such products frequently wish to supply two forms of containers, i.e., one container in which the product can be ejected by a rotary screw action such as that disclosed in FIGS. 2 and 4, and another form of container in which the product is ejected simply by finger pressure.

Figure 3:
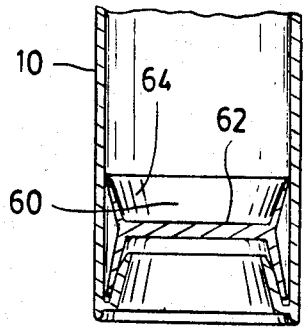
FIG. 3 is a similar section, of the lower end of such container, showing an alternate embodiment, and, FIG. 4 is a greatly enlarged section similar to FIG. 2 of the lower portion of the dispenser.

The present invention, as shown in FIG. 3, permits the use of a finger pressure applicator, using the same container 10 as shown in connection with FIGS. 1, 2, and 4.

As shown in FIG. 3, the container 10 is identical to the container 10 of FIGS. 1 and 2, and has the same sleeve 36, as shown in FIG. 4.

In this case, however, there is no requirement for a threaded shaft or a rotary drive disc. Instead, a modified form of plug member 60 is provided, having a central disc-like web 62, and a forwardly directed skirt portion 64 for making sealing engagement with the inner surface of the container 10.

A rearwardly directed bearing wall 66 is formed in a generally frusto-conical shape similar to that of the forwardly directed skirt 64. However, the bearing wall 66 extends rearwardly, and is arranged so as to overlie the inner surface of the sleeve 36 of the container 10. It is also advantageous if the free edge of such bearing wall engages the side wall of the container 10 for reasons to be described.

In the use of this form of the invention, the modified plug 60 is first of all inserted into the empty container from the upper end and slid down to the lower end. It will, of course, stop when the bearing wall 66 seats on the sleeve 36.

The container can then be filled with the stick product.

The user who wishes to dispense the stick product can then simply insert his finger in the open lower end of the container and press on the plug, and progressively dispense the stick product.

As the plug moves up through the container, any tendency for it to tip or tilt at an angle is restrained by the engagement of the bearing wall with the side wall of the container.

It will also be noted that, by having the bearing wall seat on the sleeve prior to filling, that a good and effective seal is provided, preventing the escape of any of the stick product during filling.

It will thus be seen that by the practice of the invention the containers 10 may be utilized for two different packaging systems. In this way the manufacturer can make substantial savings in inventory of packaging, and significant economies in the cost of manufacturer due to the ability to manufacture the containers 10 in greater quantities, can also be achieved.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A container adapted to receive a product therein for dispensing progressively from a dispensing end and comprising;

a tubular generally cylindrical container body having a dispensing end, and an operating end;

a plug member received within said container body, and adapted to be located near said operating end, and movable towards said dispensing end;

a disc portion on an upper side of said plug member and directed towards said product, and making sealing engagement with the inside of said container body;

a locating sleeve of frusto-conical shape within said operating end of said container formed integrally therewith;

an opening through said locating sleeve;

a screw-threaded rod extending through said threaded means axially up the centre of said container body;

a drive member attached to said threaded rod, and being rotatable from said operating end whereby to cause said plug member to move from said operating end towards said dispensing end of said container;

retaining means on said drive member engaging said locating sleeve and retaining said drive member;

a sealing collar on the underside of said plug member extending around said threaded rod;

a sealing wall portion on the underside of said plug member extending from said collar defining an interior generally cylindrical axial sealing recess, and, a sealing ring on said threaded rod dimensioned so as to be slidingly received in said cylindrical interior of said sealing wall portion when said plug member is located adjacent said operating end of said container body, whereby to provide a sliding, adjustable liquid-tight seal between said plug member and said rod during filling of said container body, said sealing wall portion being displaced away from said sealing ring, upon rotation of said rod for dispensing of said product from said dispensing end.

2. A container as claimed in claim 1 including guide formations on said container engaging said disc portion.

3. A container as claimed in claim 1 including a frusto-conical skirt on said drive member fitting within said locating sleeve, an inner rim at the narrow end of said skirt and an outer rim at the wide end of said skirt, said rims engaging said locating sleeve.

4. A container adapted to receive a product therein for dispensing progressively from a dispensing end and comprising;

a tubular generally cylindrical container body having a dispensing end, and an operating end;

a plug member received within said container body, and adapted to be located near said operating end, and movable towards said dispensing end;

a disc portion on an upper side of said plug member and directed towards said product, and making sealing engagement with the inside of said container body;

a locating sleeve of frusto-conical shape within said operating end of said container formed integrally therewith;

an opening through said locating sleeve;

a screw-threaded rod extending through said threaded means axially up the centre of said container body;

a drive member attached to said threaded rod, and being rotatable from said operating end whereby to cause said plug member to move from said operating end towards said dispensing end of said container;

retaining means on this drive member engaging said locating sleeve and retaining said drive member;

a sealing collar on the underside of said plug member extending around said threaded rod;

a sealing wall portion on the underside of said plug member extending from said collar defining an interior generally cylindrical axial sealing recess;

a sealing ring on said threaded rod dimensioned so as to be slidingly received in said cylindrical interior of said sealing wall portion when said plug member is located adjacent said operating end of said container body, whereby to provide a sliding, adjustable liquid-tight seal between said plug member and said rod during filling of said container body, said sealing wall portion being displaced away from said sealing ring, upon rotation of said rod for dispensing of said product from said dispensing end, and, a stop flange on the underside of said disc portion, and a stop member on said drive member, interengageable with said stop flange.

* * * * *